US011064761B2

(12) United States Patent
Cheney

(10) Patent No.: US 11,064,761 B2
(45) Date of Patent: Jul. 20, 2021

(54) RAPID-ENTRY FOOTWEAR COMPRISED OF A UNIFIED MATERIAL

(71) Applicant: FAST IP, LLC, Vineyard, UT (US)

(72) Inventor: Craig Cheney, Orem, UT (US)

(73) Assignee: FAST IP, LLC, Vineyard, UT (US)

( * ) Notice: Subject to any disclaimer, the term of this patent is extended or adjusted under 35 U.S.C. 154(b) by 0 days.

(21) Appl. No.: 17/074,229

(22) Filed: Oct. 19, 2020

(65) Prior Publication Data

US 2021/0112914 A1 Apr. 22, 2021

Related U.S. Application Data

(60) Provisional application No. 62/916,390, filed on Oct. 17, 2019.

(51) Int. Cl.
*A43B 11/00* (2006.01)
*A43B 23/02* (2006.01)

(52) U.S. Cl.
CPC ..... *A43B 11/00* (2013.01); *A43B 23/027* (2013.01); *A43B 23/0275* (2013.01); *A43B 23/0215* (2013.01)

(58) Field of Classification Search
CPC ..... A43B 11/00; A43B 11/02; A43B 23/027; A43B 23/0275; A43B 23/0215
USPC ..... 36/138
See application file for complete search history.

(56) References Cited

U.S. PATENT DOCUMENTS

| | | | |
|---|---|---|---|
| 112,439 | A | 3/1871 | Francis |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |
| 923,860 | A | 6/1909 | Kroell |
| 921,461 | A | 9/1909 | Rickert |
| 1,081,678 | A | 12/1913 | Langerak |
| 1,116,462 | A | 11/1914 | Moran |
| 1,464,342 | A | 8/1923 | Rothacher |
| 1,494,236 | A | 5/1924 | Greathouse |
| 1,686,175 | A | 10/1928 | Read |
| 1,926,818 | A | 9/1933 | Ratcliff |
| 2,069,752 | A | 8/1935 | Dorr |
| 2,266,732 | A | 4/1940 | Babinchak |
| 2,368,514 | A | 1/1945 | Baehr |
| 2,450,250 | A | 3/1945 | Napton |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

U.S. Appl. No. 62/186,148, filed Jun. 29, 2015, Zahabian.

(Continued)

*Primary Examiner* — Ted Kavanaugh

(57) ABSTRACT

A rapid-entry shoe having a sole portion and a rebounding portion being comprised of the same material and being a unified structure. The rapid-entry shoe has a collapsed configuration in which a perimeter of the topline is expanded and an uncollapsed configuration in which the perimeter of the topline is unexpanded, and the rapid-entry shoe is biased by the rebounding portion toward the uncollapsed configuration.

7 Claims, 7 Drawing Sheets

(56) References Cited

U.S. PATENT DOCUMENTS

| | | | | |
|---|---|---|---|---|
| 2,452,502 | A | 4/1945 | Tarbox | |
| 2,736,110 | A | 2/1956 | Hardimon | |
| 2,763,071 | A | 9/1956 | Kingsley | |
| 2,829,448 | A | 4/1958 | Minera | |
| 2,920,402 | A | 1/1960 | Minera | |
| 3,000,116 | A | 9/1961 | Ally | |
| 3,146,535 | A | 9/1964 | Owings | |
| 4,489,509 | A | 12/1984 | Libit | |
| 4,590,690 | A | 5/1986 | Pfander | |
| 4,811,502 | A | 3/1989 | Barret | |
| 4,924,605 | A | 5/1990 | Spademan | |
| 4,972,613 | A | 11/1990 | Loveder | |
| 5,054,216 | A | 10/1991 | Lin | |
| 5,127,170 | A | 7/1992 | Messina | |
| 5,181,331 | A | 1/1993 | Berger | |
| 5,184,410 | A | 2/1993 | Hamilton | |
| 5,282,327 | A | 2/1994 | Ogle | |
| 5,341,583 | A | 8/1994 | Hallenbeck | |
| 5,371,957 | A | 12/1994 | Gaudio | |
| 5,467,537 | A | 11/1995 | Aveni et al. | |
| 5,481,814 | A | 1/1996 | Spencer | |
| 5,842,292 | A | 12/1998 | Siesel | |
| 5,997,027 | A | 12/1999 | Jungkind | |
| 6,000,148 | A | 12/1999 | Cretinon | |
| 6,125,555 | A | 10/2000 | Schenkel | |
| 6,189,239 | B1 | 2/2001 | Gasparovic et al. | |
| 6,360,454 | B1 | 3/2002 | Dachgruber | |
| 6,378,230 | B1 | 4/2002 | Rotem et al. | |
| 6,671,980 | B1 | 1/2004 | Liu | |
| 6,684,533 | B1 | 2/2004 | Su | |
| 6,922,917 | B2 | 8/2005 | Kerns | |
| 6,925,732 | B1 | 8/2005 | Clarke | |
| 6,938,361 | B2 | 9/2005 | Su | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| 7,661,205 | B2 | 2/2010 | Johnson | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 | 7/2011 | Mosher | |
| D648,512 | S | 11/2011 | Schlageter | |
| 8,065,819 | B2 | 11/2011 | Kaufman | |
| 8,087,188 | B2 | 1/2012 | Labbe | |
| 8,161,669 | B2 | 4/2012 | Keating | |
| 8,225,535 | B2 | 7/2012 | Dillenbeck | |
| 8,499,474 | B2 | 8/2013 | Kaufman | |
| 8,769,845 | B2 | 7/2014 | Lin | |
| 9,615,624 | B2 | 4/2017 | Kilgore et al. | |
| 9,675,132 | B2 | 6/2017 | Marshall | |
| 9,820,527 | B2 | 11/2017 | Pratt et al. | |
| 9,877,542 | B2 | 1/2018 | Pratt | |
| 10,306,947 | B2 | 6/2019 | Pratt et al. | |
| 10,455,898 | B1 | 10/2019 | Orand et al. | |
| 10,638,810 | B1 * | 5/2020 | Cheney | A43B 3/248 |
| 2002/0144434 | A1 | 10/2002 | Farys | |
| 2005/0022428 | A1 | 2/2005 | Anderson | |
| 2005/0039348 | A1 | 2/2005 | Raluy et al. | |
| 2005/0076540 | A1 | 4/2005 | Su | |
| 2005/0198867 | A1 | 9/2005 | Labbe | |
| 2007/0074425 | A1 | 4/2007 | Leong | |
| 2008/0086911 | A1 | 4/2008 | Labbe | |
| 2008/0189984 | A1 | 8/2008 | Januszewski et al. | |
| 2008/0307673 | A1 | 12/2008 | Johnson | |
| 2011/0016751 | A1 | 1/2011 | Somerville | |
| 2011/0146106 | A1 | 6/2011 | Kaufman | |
| 2012/0216429 | A1 | 8/2012 | Bastida et al. | |
| 2012/0317839 | A1 | 12/2012 | Pratt | |
| 2013/0185959 | A1 | 7/2013 | Coleman | |
| 2013/0219747 | A1 | 8/2013 | Lederer | |
| 2015/0305432 | A1 | 10/2015 | Wiens | |
| 2016/0374427 | A1 | 12/2016 | Zahabian | |
| 2017/0303632 | A1 | 10/2017 | Pratt | |
| 2017/0360143 | A1 | 12/2017 | Pratt | |
| 2017/0360151 | A1 | 12/2017 | Pratt | |
| 2018/0110287 | A1 | 4/2018 | Hopkins et al. | |
| 2018/0110292 | A1 | 4/2018 | Beers et al. | |
| 2018/0289109 | A1 | 10/2018 | Beers et al. | |
| 2018/0295942 | A1 | 10/2018 | Drake | |
| 2020/0253333 | A1 * | 8/2020 | Kilgore | A43B 3/0063 |
| 2021/0112916 | A1 * | 4/2021 | Schulten | A43B 23/0245 |

FOREIGN PATENT DOCUMENTS

| | | |
|---|---|---|
| CN | 201005111 | 1/2008 |
| DE | 19534249 | 3/1997 |
| DE | 19611797 | 10/1997 |
| DE | 29809404 | 8/1998 |
| DE | 10247163 | 10/2002 |
| DE | 102004005288 | 8/2005 |
| EP | 1059044 | 12/2000 |
| GB | 2517399 | 8/2013 |
| JP | 181910 | 6/1989 |
| JP | 2001149394 | 6/2001 |
| JP | 2006055571 | 3/2006 |
| WO | 2007080205 | 7/2007 |
| WO | 2009089572 | 7/2009 |
| WO | 2009154350 | 12/2009 |
| WO | 2017004135 | 1/2017 |

OTHER PUBLICATIONS

International Search Report and Written Opinion dated Jan. 5, 2021 in PCT International Patent Application No. PCT/US2020/056355.

Sneider, "Kizik Handsfree New York Shoe Review," https://the-gadgeteer.com/2018/06/27/kizik-handsfree-new-york-show-review/ (2018).

https://www.teva.com/kids-sandals/hurricane-drift/ 1102483C.html submitted herewith as of Jun. 13, 2019.

https://us.ecco.com/ecco-biom-fjuel-mens-outdoor-shoe-837594.html?dwvar_837594_color=00001 submitted herewith as of Jun. 1, 2016.

* cited by examiner

RAPID-ENTRY FOOTWEAR COMPRISED OF A UNIFIED MATERIAL

CROSS-REFERENCE TO RELATED APPLICATION

This application claims the benefit of U.S. Provisional Patent Application No. 62/916,390, filed Oct. 17, 2019 and entitled "Rapid-Entry Footwear Having a Unified Material," which is incorporated herein by reference in its entirety for all purposes.

FIELD

The present disclosure relates to footwear, and more particularly to rapid-entry footwear comprised of a unified material.

BACKGROUND

Whether due to inconvenience or inability, donning and doffing of shoes, including tying or otherwise securing the same, may be undesirable and/or present difficulties to some individuals. The present disclosure addresses this need.

SUMMARY

A rapid-entry shoe in accordance with an example embodiment of the present disclosure comprises a sole portion, an upper coupled to the sole portion, the upper defining a topline, and a rebounding portion, the rebounding portion extending in an upward and rearward direction toward a rear portion of the upper.

In various embodiments, the sole portion and the rebounding portion are comprised of the same material and are a unified structure.

In various embodiments, the rebounding portion defines a window at the rear portion of the upper, the window being devoid of any heel counter.

In various embodiments, the rapid-entry shoe has a collapsed configuration in which a perimeter of the topline is expanded and an uncollapsed configuration in which the perimeter of the topline is unexpanded. In various embodiments, the rapid-entry shoe is biased by the rebounding portion toward the uncollapsed configuration.

In accordance with an example embodiment of the present disclosure, a rapid-entry shoe comprises a rear stabilizer. The rear stabilizer can be coupled to the rebounding portion. The rear stabilizer can be more rigid than the rebounding portion. The rear stabilizer can extend around the rear portion of the upper. The rear stabilizer can be configured to prevent inward deflection of the rebounding portion when the rapid entry shoe is deformed to the collapsed configuration.

In accordance with an example embodiment of the present disclosure, the rebounding portion or the rear stabilizer comprises a narrowed neck portion.

In accordance with an example embodiment of the present disclosure, the rebounding portion comprises a deflection feature configured to disperse deflection of the rebounding portion along a line, area or volume.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
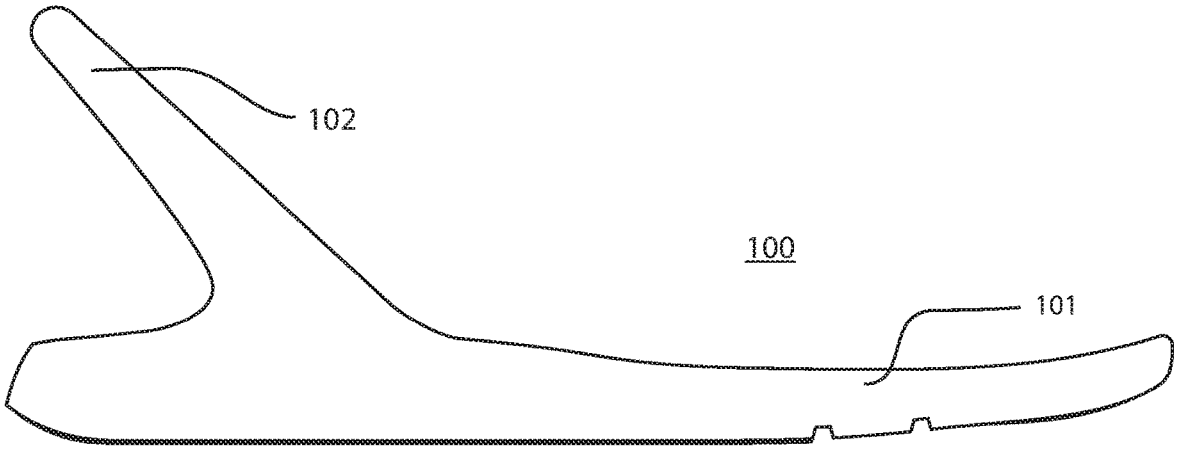
FIGS. 1A and 1B illustrate rapid-entry shoes having a rebounding portion in accordance with example embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe, for example, an insole or an internal cushion.

Example embodiments of the present disclosure comprise a rapid-entry shoe having an uncollapsed configuration and a collapsed configuration, as described below, wherein a sole portion and a rebounding portion are comprised of a unified material.

Figure 1B:
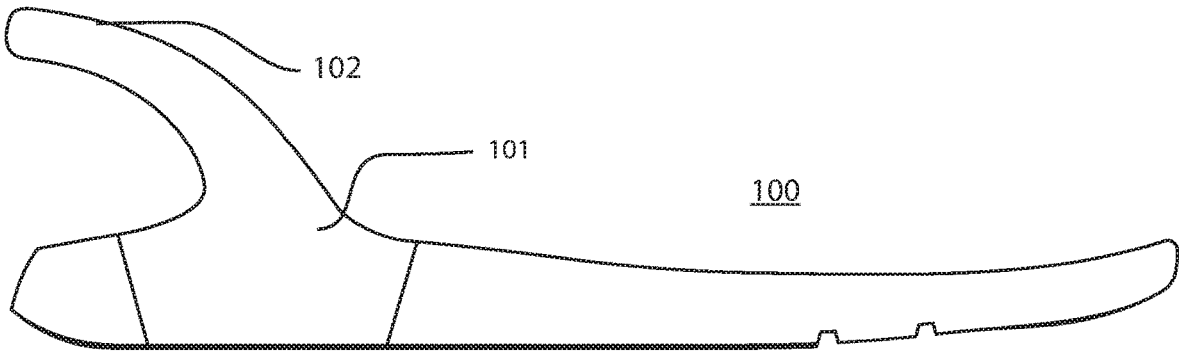

Turning to specific embodiments, and with reference to FIGS. 1A and 1B, in accordance with example embodiments of the present disclosure, a rapid-entry shoe 100 generally comprises a sole portion 101 and a rebounding portion 102.

Sole portion 101 can extend from the rearward most portion of rapid-entry shoe 100 to the forward most portion of rapid-entry shoe 100 (FIG. 1A). Alternatively, sole portion 101 can extend only partially between the rearward most portion of rapid-entry shoe 100 and the forward most portion of rapid-entry shoe 100, for example, at or near an arch or rear portion of an upper (FIG. 1B). In example embodiments, sole portion 101 is an outsole (or a portion thereof) comprising a tread pattern and/or a kick plate. In example embodiments, sole portion 101 is a midsole (or a portion thereof) comprising a kick plate. In example embodiments, a kick plate is a hardened material on which a user can kick to assist in removal of rapid-entry shoe 100.

Sole portion 101 generally extends between medial and lateral sides of rapid-entry shoe 100, where rebounding portion 102 begins.

As used herein, unless the context dictates otherwise, a "rebounding portion" of a rapid-entry shoe refers to one or more structures extending partially or completely around a rear portion of an upper, the one or more structures configured to bias a rear portion of an upper upward such that the rapid-entry shoe is biased toward an uncollapsed configuration.

As used herein, unless the context dictates otherwise, a "rear portion of an upper" refers to any rear portion of an upper, for example, a heel portion or backstrap, including a topline thereof.

Rebounding portion 102 can extend from at or near a sole portion (e.g., at or near an arch thereof) in an upward direction toward a rear portion of an upper. Alternatively, or additionally, rebounding portion 102 can extend from a rear portion of an upper to a topline (or proximal a topline) of the upper. In this regard, rebounding portion 102 can be configured to direct downward compression (and corresponding rebound) of a rear portion of an upper.

In some embodiments, rebounding portion 102 is configured to direct rearward leaning (and corresponding rebound) of a rear portion of an upper (in addition to downward compression). In this regard, rebounding portion 102 can extend from sole portion 101 at an angle (i.e., in an upward and rearward direction toward a rear portion of an upper) or otherwise be configured to encourage a rear portion of an upper to deflect in a way to increase the overall opening of the rapid-entry shoe 100.

Rebounding portion can be coupled to, or otherwise positioned on, an inner or outer surface of an upper (or between an inner and outer surface). Alternatively, no upper is necessary in some embodiments (e.g., in embodiments wherein rebounding portion 102 is a rear strap, as in a sandal or a clog).

In connection with example embodiments of the present disclosure, rebounding portion 102 defines a deflection feature. The deflection feature can be defined by a line, area or volume on rebounding portion 102 having a mechanical property different from that of an adjacent line, area or volume on rebounding portion 102, the mechanical property being one or more of material, cross-section, thickness, geometry, twisting and density. In this regard, the deflection feature can disperse deflection along a line, area or volume, rather than focus deflection at a distinct or discrete point. In example embodiments, the deflection feature is more flexible than adjacent rebounding portion 102.

Figure 2A:
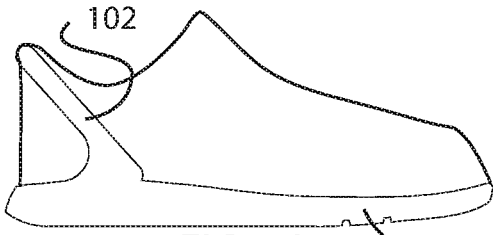
FIGS. 2A-2X illustrate geometries of a rebounding portion in accordance with example embodiments.
Figure 2B:
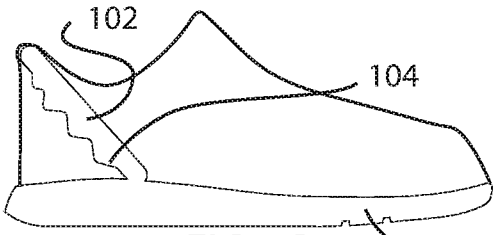
Figure 2C:
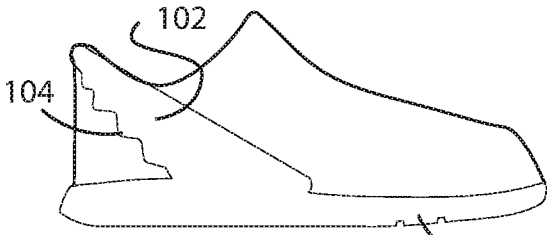
Figure 2D:
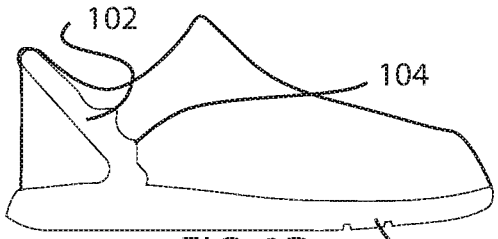
Figure 2E:
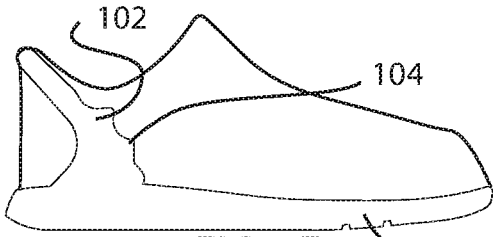
Figure 2F:
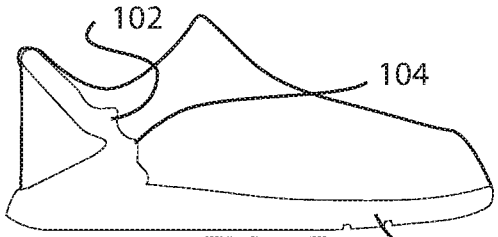
Figure 2G:
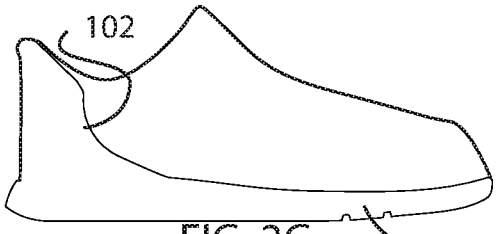
Figure 2H:
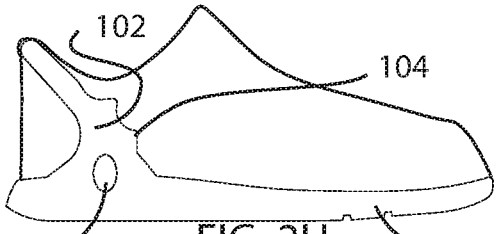
Figure 2I:
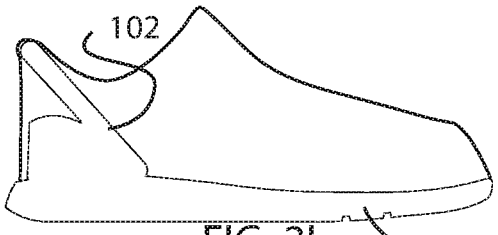
Figure 2J:
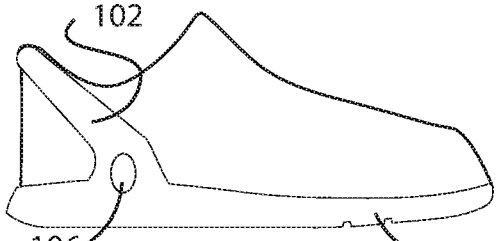
Figure 2K:
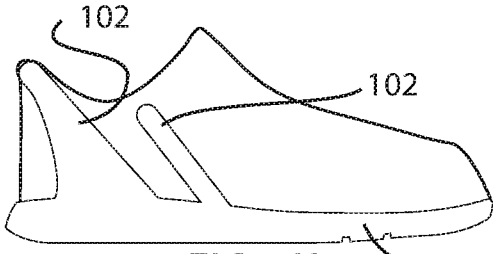
Figure 2L:
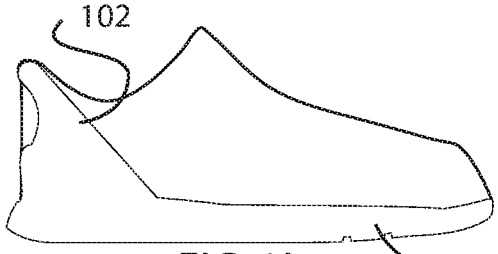
Figure 2M:
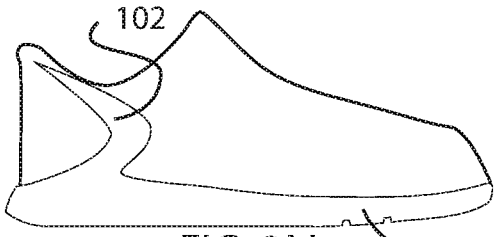
Figure 2N:
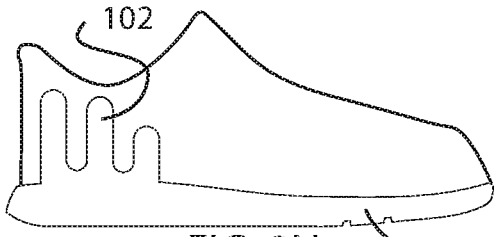
Figure 2O:
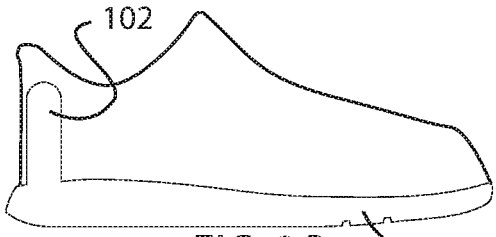
Figure 2P:
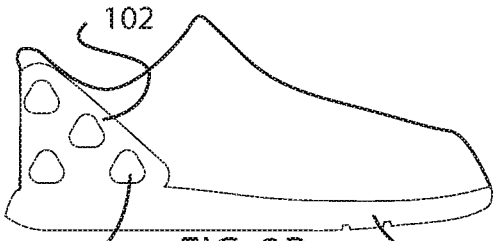
Figure 2Q:
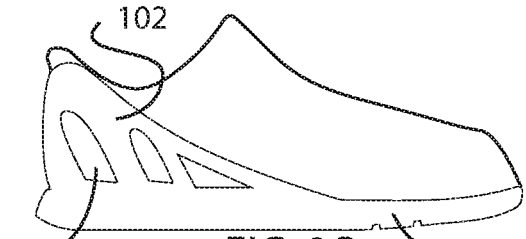
Figure 2R:
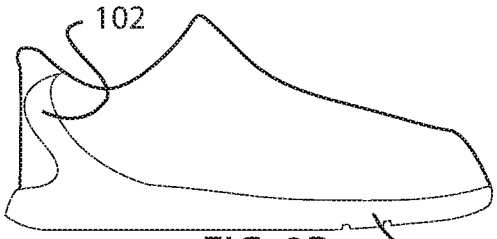
Figure 2S:
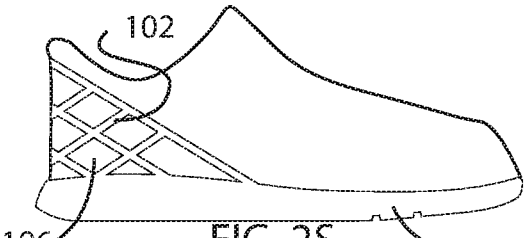
Figure 2T:
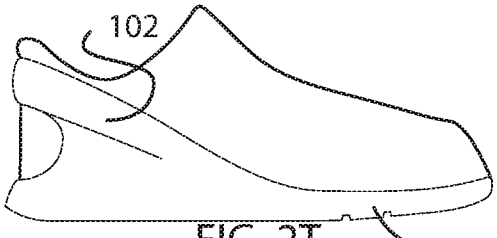
Figure 2U:
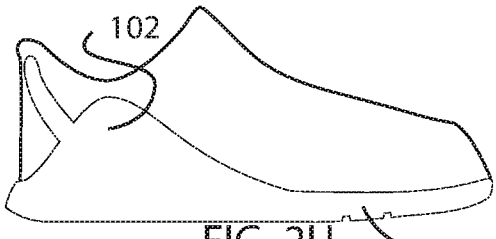
Figure 2V:
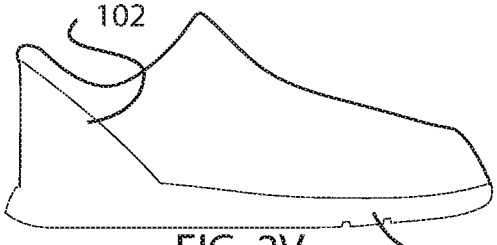
Figure 2W:
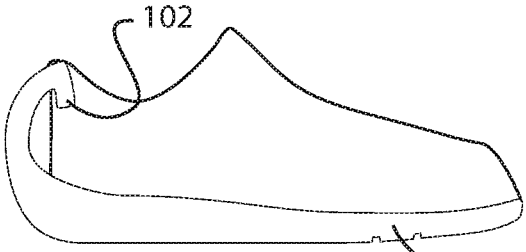
Figure 2X:
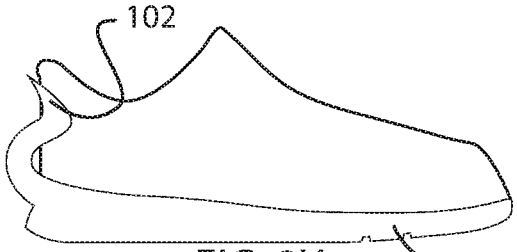

With reference to FIGS. 2A-2X, rebounding portion 102 can comprise a variety of geometries. In example embodiments, rebounding portion 102 comprises a dimension (e.g., cross-section) closer to sole portion 101 that is larger than a dimension further from sole portion 101.

In some embodiments, the geometry of rebounding portion 102 facilitates deformation, for example, by having stepped or scalloped edges 104 on a forward and/or rearward portion of rebounding portion 102 (e.g., FIGS. 2B-2F and 2H), or by having one or more apertures 106 in a side of rebounding portion 102 (e.g., FIGS. 2H, 2J, 2P, 2Q and 2S). Still other embodiments can comprise a plurality of rebounding portions 102 (e.g., FIGS. 2K and 2N).

While in some embodiments, rebounding portion extends completely around a rear portion of an upper, in other embodiments, and with reference to FIGS. 2M-20 and 2R, rebounding portion is positioned exclusively on a lateral and/or medial side of a rear portion of an upper (i.e., does not extend around a rear portion of an upper).

Figure 3A:
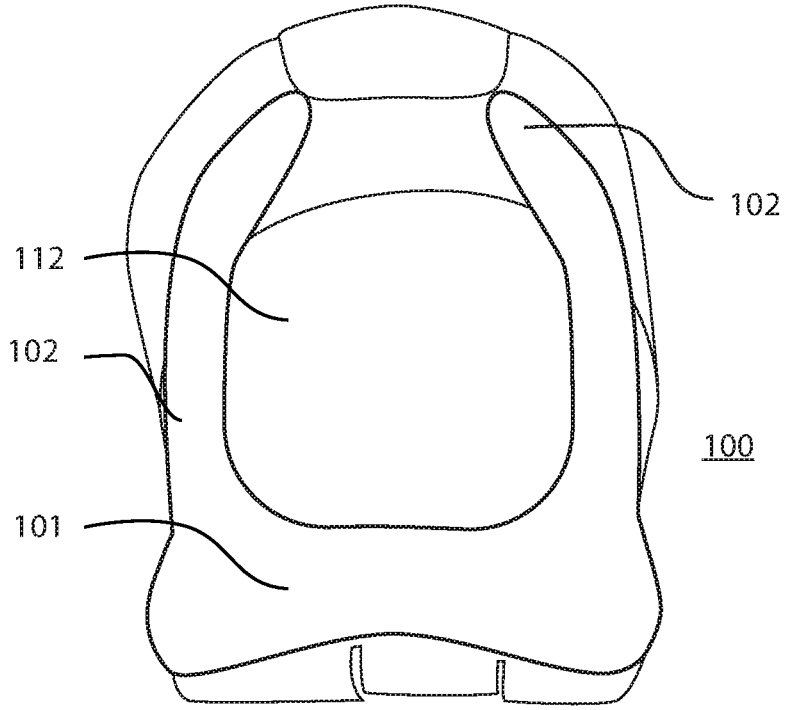
FIGS. 3A and 3B illustrate a rebounding portion not extending completely around a heel and extending completely around a heel, respectively, all in accordance with example embodiments.
Figure 3B:
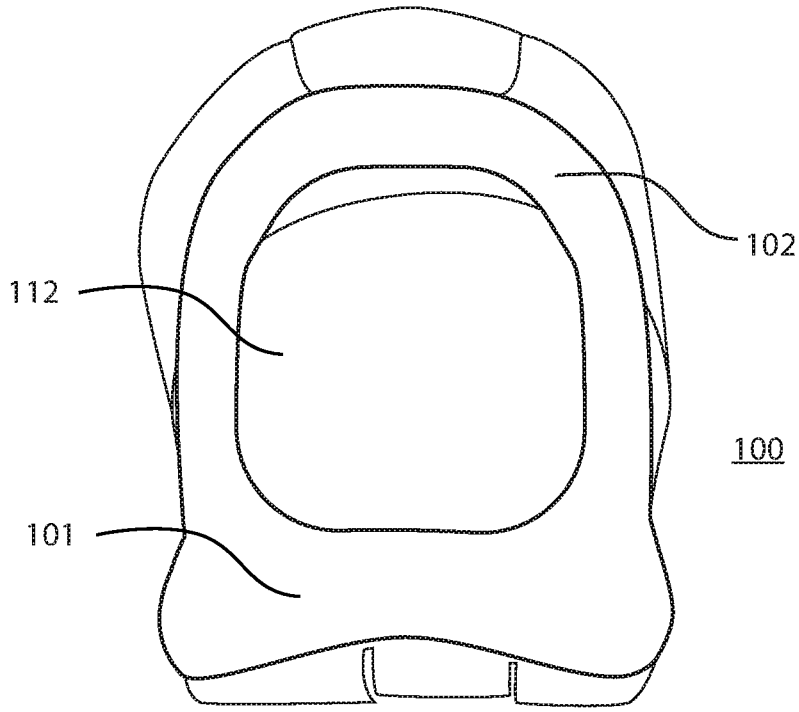

In connection with example embodiments of the present disclosure, and with reference to FIGS. 3A and 3B, rebounding portion 102 forms a loop around a rear portion of an upper. That is, in example embodiments, a window 112 is defined at or near a rear portion of an upper, the window 112 extending between a bottom surface of rebounding portion 102 and a top surface of sole portion 101. Window 112 can be a void of material (i.e., a pass-through aperture). Alternatively, widow 112 can be a narrowed section of rebounding portion 102.

In this regard, when rapid-entry shoe 100 moves from an uncollapsed configuration to a collapsed configuration, as discussed below, the window 112 can receive rebounding portion 102 being compressed downward by a user's foot. In example embodiments, the window 112 has a triangle-like shape or any other elliptical, non-elliptical, or random shape.

As used herein, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like as well as other shapes that have at least one angle even if those shapes do not have designations common in Euclidian geometry.

In example embodiments, the window 112 is devoid of any rigid structure (even though the upper may close the window 112), for example a heel counter to reinforce a heel cup or any other structure that prevents resilient deformation of window 112, for example, between a top edge of a bottom portion of window 112 and a bottom edge of a top portion of window 112. In example embodiments, any upper material that closes window 112 is flexible.

While in some embodiments an upper material fills window 112, in other embodiments, no upper material fills window 112 (e.g., in embodiments wherein rebounding portion 102 is a rear strap, as in a sandal or a clog).

In some embodiments, rebounding portion 102 extends from a medial side of rapid-entry shoe 100 and from a lateral side of rapid-entry shoe 100, but not completely around a rear portion of an upper (FIG. 3A). In other embodiment, rebounding portion 102 extends from one but not both of a medial side of rapid-entry shoe 100 and a lateral side of rapid-entry shoe 100. In still other embodiments, rebounding portion 102 extends between a medial side of rapid-entry shoe 100 and a lateral side of rapid-entry shoe 100, completely and continuously around a rear portion of an upper (FIG. 3B).

In some embodiments, whether rebounding portion 102 does not extend completely around a rear portion of an upper (FIG. 4A) or whether rebounding portion 102 does extend completely around a rear portion of an upper (FIG. 4B), a rear stabilizer 110 can be coupled to rebounding portion at or near a rear portion of an upper (e.g., configured to extend around a rear portion of an upper at or near a topline thereof).

In general, rear stabilizer 110 can be configured to direct a rear portion of an upper to compress downward and/or lean rearward (and prevent a rear portion of an upper from deflecting inward, which would reduce the perimeter of the opening of rapid-entry shoe 100). In this regard, in example embodiments, rear stabilizer 110 is configured to prevent inward deflection of the rebounding portion when the rapid entry shoe is deformed to the collapsed configuration.

In some embodiments, the rear stabilizer 110 is v-shaped, u-shaped, horse-shoe-shaped (with consistent or inconsistent curvature as it rounds a rear portion of an upper), or otherwise has an elongated shape, and thus wraps around a rear portion of an upper. Rear stabilizer 110 can be coupled to an inside or outside surface of rebounding portion 102, or be embedded within rebounding portion 102.

Figure 4A:
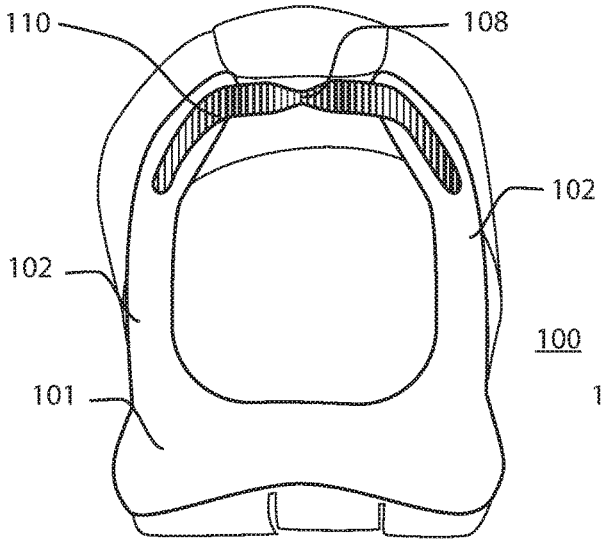
FIGS. 4A-4C illustrate embodiments of the present disclosure comprising a rear stabilizer.
Figure 4B:
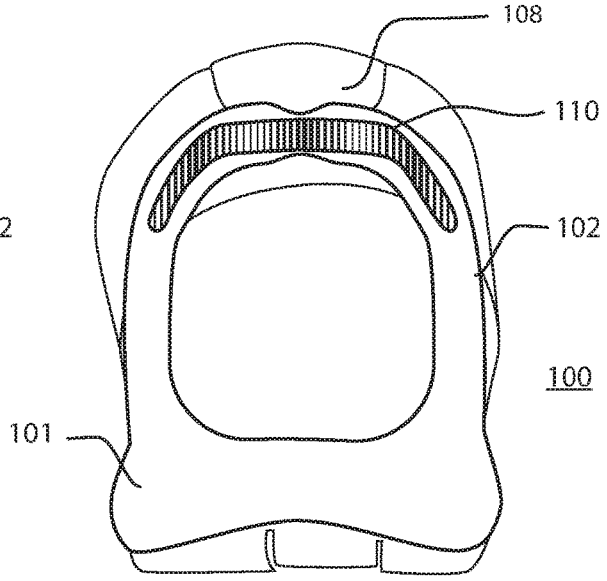
Figure 4C:
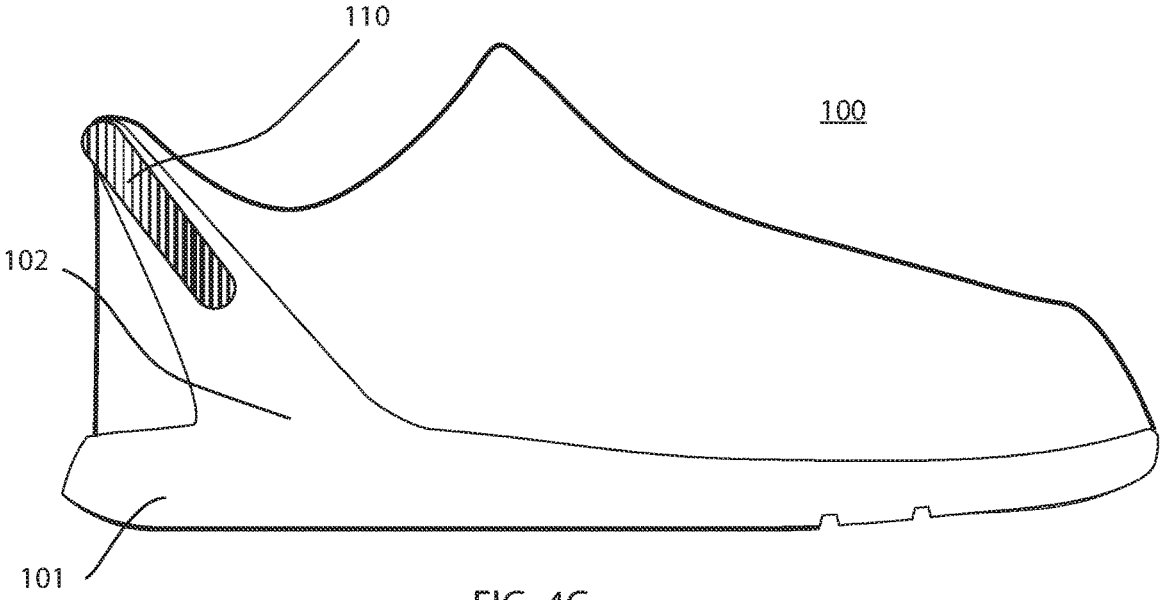

In example embodiments, rear stabilizer 110 comprises a mechanical property different from that of an adjacent rebounding portion 102, the mechanical property being one or more of material, cross-section, thickness, geometry, twisting and density. For instance, rear stabilizer 110 can comprise a reinforced section of rebounding portion 102. FIG. 4C shows a side view of the foregoing embodiments. In example embodiments, rear stabilizer 110 is more rigid than adjacent rebounding portion 102.

Without limiting the foregoing, in some embodiments rear stabilizer 110 can be comprised of a thicker or more dense section of the same material of which rebounding portion 102 is comprised, but geometrically adjusted to provide stability to rebounding portion 102.

In some embodiments, rebounding portion 102 and/or rear stabilizer 110 can comprise a neck portion 108 at or near a rear portion of an upper. In example embodiments, neck portion 108 comprises a mechanical property different from that of an adjacent rebounding portion 102 or rear stabilizer 110, the mechanical property being one or more of material, cross-section, thickness, geometry, twisting and density. For instance, neck portion 108 can comprise a narrowed section of rebounding portion 102 (FIG. 4B) and/or rear stabilizer 110 (FIG. 4A) to conform to a user's Achilles. In example embodiments, neck portion 108 is narrower and/or more flexible than adjacent rebounding portion 102 or rear stabilizer 110.

Figure 5A:
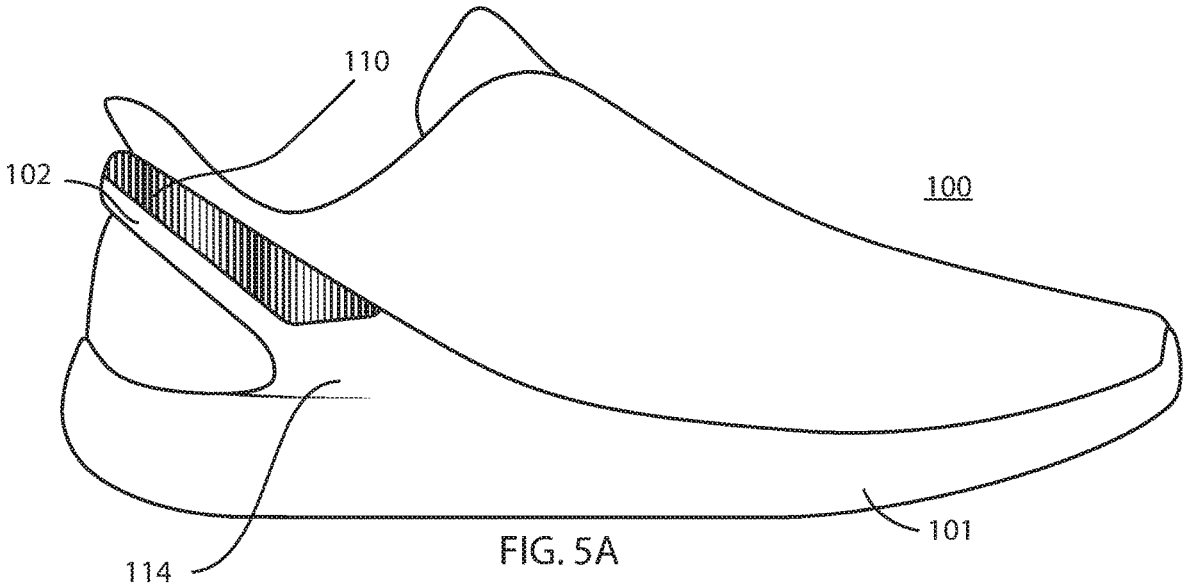
FIGS. 5A and 5B illustrate side and rear views, respectively, of another example embodiment of a rapid-entry shoe with a sole portion and a rebounding portion comprised of a unified material.
Figure 5B:
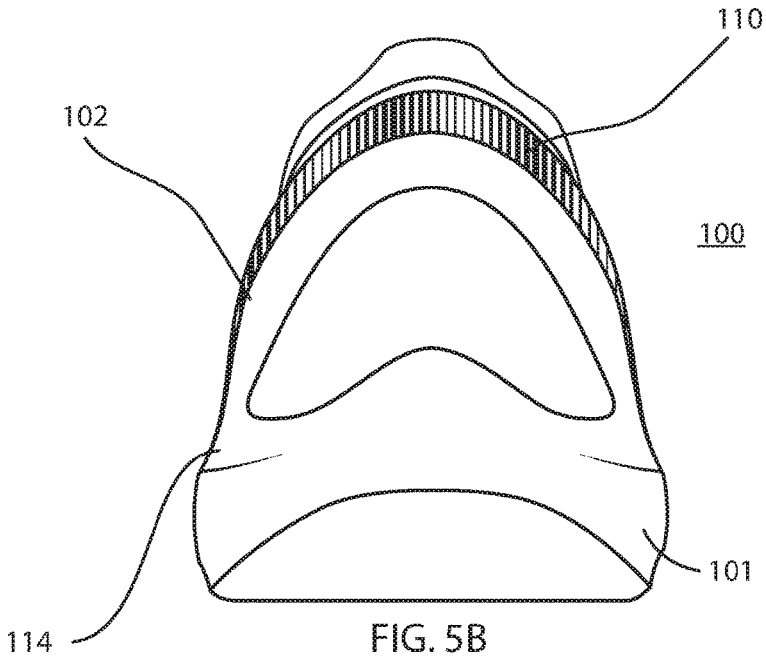

Another example of a rapid-entry shoe with a sole portion 101 and a rebounding portion 102 comprised of a unified material is described with reference to FIGS. 5A and 5B. A deflection feature 114 extends along an underside of a length of rebounding portion 102. In this regard, deflection feature 114 disperses downward compression and rearward leaning rather than it being concentrated at a distinct or discrete point.

In accordance with example embodiments of the present disclosure, sole portion 101 and rebounding portion 102 are comprised of a unified material. Stated differently, sole portion 101 and rebounding portion 102 can be comprised of a common material, and be a unified structure, or otherwise be coupled, continuous, integral or unitary one with another. For example, sole portion 101 and rebounding portion 102 may be formed from a common mold.

Notwithstanding the foregoing, in example embodiments, sole portion 101 and rebounding portion 102 may have different densities of the same material. For instance, the density at a junction or deflection feature between sole portion 101 and rebounding portion 102 may be relatively less than away from the junction, so as to facilitate resilient deformation of rebounding portion 102 relative to sole portion 101.

In accordance with example embodiments of the present disclosure, the cross-section of sole portion 101 and rebounding portion 102 is solid (i.e., material properties consistent through the entire cross-section). In some example embodiments, at least one of sole portion 101 and rebounding portion 102 surrounds a separate and distinct material contributing to resilient deformation of rebounding portion 102 (e.g., a shape-memory material like a wire, filament or other resiliently deformable element) embedded therein. In other example embodiments, at least one of sole portion 101 and rebounding portion 102 comprises a hollow portion.

Sole portion 101 and rebounding portion 102 can be comprised of materials known in the art, for example, a styrene-butadiene copolymer, polyvinyl chloride, urethane or another polymer material, thermoplastic rubber (TRP), silicone, styrene-ethylene/butylene-styrene (SEBS), nylon, acetal homopolymer/polyoxymethylene, aluminum, TPU, TPC-ET, polypropylene, acrylic resin, rubber, ABS, and polycarbonate. In general, sole portion 101 and rebounding portion 102 can be comprised of a material exhibiting resilient deformability.

In example embodiments, the rebounding portion 102 is configured to be deformed by a downward force of less than about 20 pounds, or less than about 15 pounds, and is further configured to resist being deformed by a downward force of less than 2 about pounds, or less than about 1 pound. In this regard, the rebounding portion 102 can be more rigid than a typical sandal of the prior art, but less rigid than a typical closed-toe shoe of the prior art.

In example embodiments, sole portion 101 and rebounding portion 102 are comprised of a material exhibiting resilient deformability such that rebounding portion 102 biases a topline of the rapid-entry shoe upward, toward an uncollapsed configuration.

In this regard, as noted above, rapid-entry shoe 100 in accordance with example embodiments of the present disclosure comprises an uncollapsed configuration and a collapsed configuration.

Figure 6A:
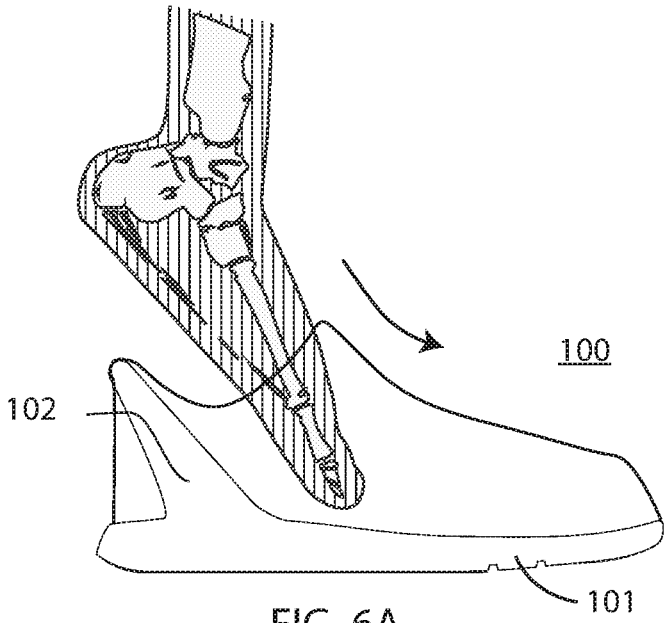
FIGS. 6A-6C illustrate uncollapsed and collapsed configurations of a rapid-entry shoe having a rebounding portion in accordance with an example embodiment.
Figure 6B:
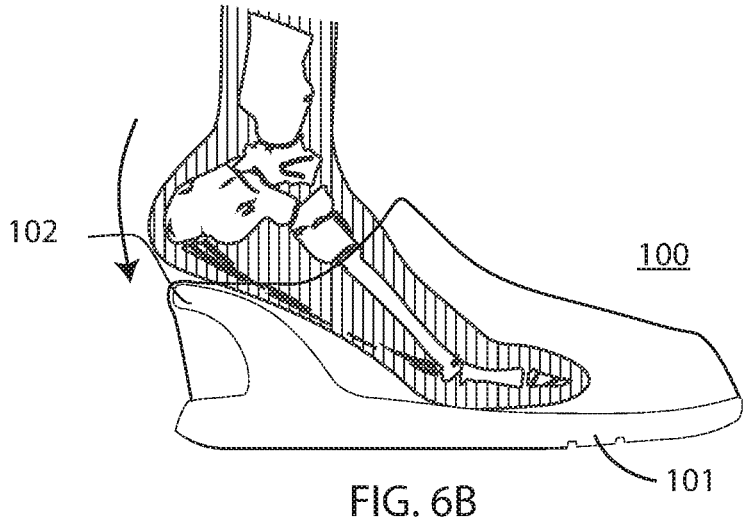
Figure 6C:
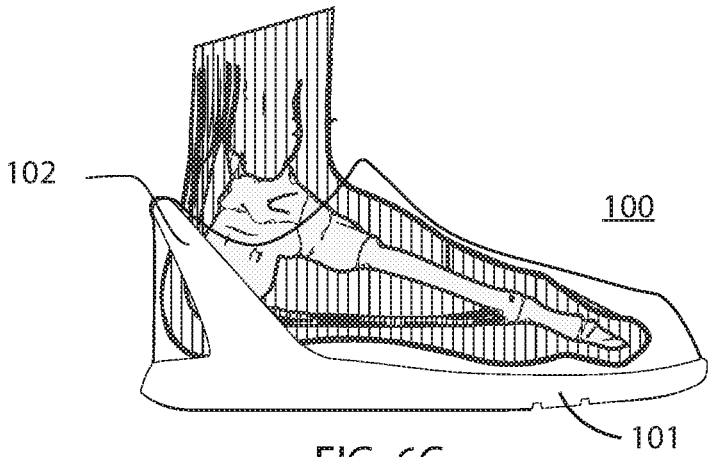

With reference to FIGS. 6A-6C, in a collapsed configuration (as illustrated in FIG. 6B), a rear portion of an upper of a rapid-entry shoe 100 is compressed toward a sole portion 101 of a rapid-entry shoe 100, and a rebounding portion 102 is compressed. Thus, in a collapsed configuration, a rebounding portion 102 can compress out of the way of a heal to enlarge the opening of rapid-entry shoe 100 for easy entry/exit. In other words, in a collapsed configuration, a dimension of an opening of the shoe (e.g., a perimeter following the topline of the opening, or a perimeter around the topline of the opening measured in a single plane) may be greater than in an uncollapsed configuration, to facilitate easy entry/exit.

In an uncollapsed configuration (as illustrated in FIGS. 6A and 6C), a rear portion of an upper of a rapid-entry shoe 100 can be extended away from a sole portion 101 of a rapid-entry shoe 100, and a rebounding portion 102 is either not compressed or only partially compressed. In example embodiments, a rapid-entry shoe 100, or a topline of a rear portion of a rapid-entry shoe 100, can be biased toward an uncollapsed configuration by a rebounding portion 102. Stated another way, in example embodiments, a rapid-entry shoe 100 at rest is in an uncollapsed configuration. In example embodiments, rebounding portion 102 biases the topline toward the uncollapsed configuration.

In example embodiments of an uncollapsed configuration, a rebounding portion 102 can create or otherwise enhance rebound of a rear portion of an upper of a rapid-entry shoe 100 toward an uncollapsed configuration, for example, at a topline of a rapid-entry shoe 100. Thus, a rebounding portion 102 can lift a rear portion of an upper of a rapid-entry shoe 100 and thereby provide support and/or retention to a heel inserted into a rapid-entry shoe 100.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

I claim:

1. A rapid-entry shoe comprising:

a sole portion;

an upper coupled to the sole portion, the upper defining a topline; and a rebounding portion, the rebounding portion extending in an upward and rearward direction toward a rear portion of the upper;

wherein the rebounding portion defines a window at the rear portion of the upper, the window being closed with the upper but further being devoid of any heel counter;

wherein the sole portion and the rebounding portion are comprised of a common material and are a unified structure;

wherein the rapid-entry shoe has a collapsed configuration in which a perimeter of the topline is expanded;

wherein the rapid-entry shoe has an uncollapsed configuration in which the perimeter of the topline is unexpanded;

wherein the rapid-entry shoe is biased by the rebounding portion toward the uncollapsed configuration;

further comprising a rear stabilizer, wherein:

the rear stabilizer is coupled to the rebounding portion;

the rear stabilizer is more rigid than the rebounding portion;

the rear stabilizer extends around the rear portion of the upper; and the rear stabilizer is configured to prevent inward deflection of the rebounding portion when the rapid entry shoe is deformed to the collapsed configuration.

2. The rapid-entry shoe of claim 1, wherein the rebounding portion or the rear stabilizer comprises a narrowed neck portion.

3. A rapid-entry shoe comprising:

a sole portion;

an upper coupled to the sole portion, the upper defining a topline;

a rebounding portion, the rebounding portion extending in an upward and rearward direction toward a rear portion of the upper; and a rear stabilizer coupled to the rebounding portion and configured to prevent inward deflection of the rebounding portion;

wherein the rear portion of the upper comprises a window being devoid of any structure that prevents resilient deformation of the window;

wherein the sole portion and the rebounding portion are comprised of a common material and are a unified structure;

wherein the rapid-entry shoe has a collapsed configuration in which a perimeter of the topline is expanded;

wherein the rapid-entry shoe has an uncollapsed configuration in which the perimeter of the topline is unexpanded;

wherein the rapid-entry shoe is biased by the rebounding portion toward the uncollapsed configuration;

wherein the rear stabilizer is more rigid than the rebounding portion.

4. The rapid-entry shoe of claim 3, wherein the rebounding portion or the rear stabilizer comprises a narrowed neck portion.

5. The rapid-entry shoe of claim 3, wherein the rebounding portion comprises a deflection feature configured to disperse deflection of the rebounding portion along a line, area or volume.

6. The rapid-entry shoe of claim 3, wherein the rebounding portion is configured to be deformed by a downward force of less than about 20 pounds and is further configured to resist being deformed by a downward force of less than about 1 pound.

7. The rapid-entry shoe of claim 3, wherein the common material comprises a styrene-butadiene copolymer.

* * * * *